US005875971A

United States Patent [19]

Morck

[11] Patent Number: 5,875,971

[45] Date of Patent: Mar. 2, 1999

[54] SPRAY GUN

[75] Inventor: Werner Morck, Hargesheim, Germany

[73] Assignee: Bruno Jesswein Kunststofftechnik, Germany

[21] Appl. No.: 737,564

[22] PCT Filed: May 11, 1995

[86] PCT No.: PCT/EP95/01787

§ 371 Date: May 13, 1997

§ 102(e) Date: May 13, 1997

[87] PCT Pub. No.: WO95/31290

PCT Pub. Date: Nov. 23, 1995

[30] Foreign Application Priority Data

May 13, 1994 [DE] Germany ..... 44 16 939.6

[51] Int. Cl.[6] ..... B05B 7/30

[52] U.S. Cl. ..... 239/345; 239/302; 239/346; 239/377; 239/DIG. 14

[58] Field of Search ..... 239/302, 345, 239/346, 377, DIG. 14

[56] References Cited

U.S. PATENT DOCUMENTS

| | | | |
|---|---|---|---|
| 2,754,152 | 7/1956 | Gilmour . | |
| 3,236,459 | 2/1966 | McRitchie | 239/345 X |
| 5,069,389 | 12/1991 | Bitsakos | 239/345 X |
| 5,366,158 | 11/1994 | Robisch et al. | 239/345 |

FOREIGN PATENT DOCUMENTS

| | | | |
|---|---|---|---|
| A0284512 | 9/1988 | European Pat. Off. . | |
| 3815327 | 5/1988 | Germany . | |
| A3710395 | 10/1988 | Germany . | |
| 1512675 | 10/1989 | U.S.S.R. | 239/345 |
| 139833 | 3/1920 | United Kingdom | 239/345 |
| A290866 | of 1928 | United Kingdom . | |

OTHER PUBLICATIONS

Richter, sections entitled "Rastwerke" and Verriegelungen from *Bauelemente der Feinmechanik* (*Construction Elements of Fine Mechanics*), Berlin: VDI–Verlag GmbH, pp. 484–501, 1929.

*Primary Examiner*—Andres Kashnikow
*Assistant Examiner*—Robin O. Evans
*Attorney, Agent, or Firm*—Majestic, Parsons, Siebert & Hsue

[57] ABSTRACT

A spray gun is provided with a handle part (6) and a housing (2) having a connecting part (3) for a pressure can, said connecting part being provided with a check valve. The housing (2) receives a nozzle pipe (10) bearing a nozzle (11) at the free end, into which pipe a spring-loaded nozzle needle (12) acting upon the opening of the nozzle (11) extends. The nozzle needle is operable via a pivoted lever (9) mounted in the housing (2). To permit the position of the pressure can to be varied and fixed relative to the handle part (6) while involving a simple structure, the housing part (17) bearing the connecting part (3) for the pressure can is adapted to be rotated around the axis (19) of the nozzle needle (12) relative to the housing part (18) bearing the handle part (6).

15 Claims, 4 Drawing Sheets

SPRAY GUN

Figure 1:
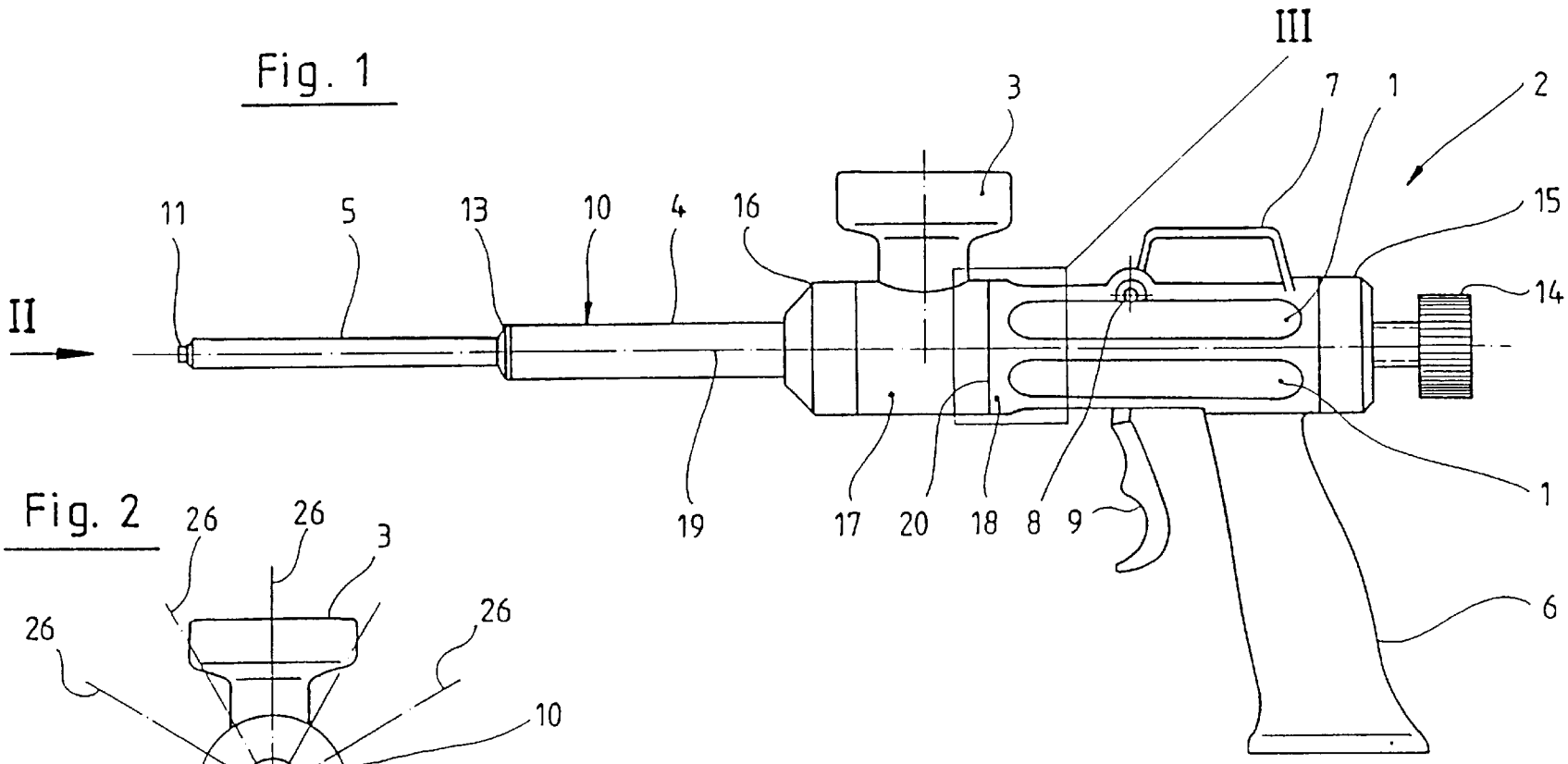

This invention relates to a spray gun having a handle part and a housing having a connecting part for a pressure can, said connecting part being provided with a check valve, said housing receiving a nozzle pipe bearing a nozzle at the free end, into which pipe a spring-loaded nozzle needle acting upon the opening of the nozzle extends, said needle being operable via a pivoted lever mounted on the housing. Such a spray gun is suitable in particular for discharging plastic sealing foams, for example polyurethane foams.

DE 37 10 395 A1 discloses such a spray gun. The connecting part is connected integrally and firmly with the housing, thereby fixing the position of the pressure can invariably relative to the handle part on the housing. Depending on the type of medium in the pressure can, it may be necessary for the pressure can to assume an angular alignment to the horizontal. The space conditions at the place of use of the spray gun also sometimes make it necessary for the pressure can to assume a different position relative to the handle part since firm alignment prevents optimal handling of the spray gun. Via the handle part the slanted pressure can furthermore causes a tilting moment on the wrist which causes a strain thereon and sometimes also necessitates support by the second hand.

The invention is based on the problem of providing a spray gun of the abovementioned type which permits the position of the pressure can to be adjusted relative to the handle part while the spray gun still has a simple structure.

This problem is solved according to the invention in that the housing part bearing the connecting part for the pressure can is adapted to be rotated around the axis of the nozzle needle relative to the housing part bearing the handle part.

This measure permits the position of the pressure can to be adapted quickly to the necessary conditions, thereby guaranteeing quick work with minimal strain on the user.

Obviously the rotatability of the housing part bearing the connecting part relative to the housing part bearing the handle part is limited in so far as a certain expenditure of force is required to change the position. This is obtained for example by frictionally engaged bracing of the housing part bearing the connecting part on the housing part bearing the handle part, or by the formation of snap-in positions.

According to an advantageous embodiment of the invention, the housing part bearing the connecting part has a projection having a snap ring and inserted into a bore of the housing part bearing the handle part, the snap ring disposed in a groove in the projection jumping up behind a shoulder of the housing part bearing the handle part, thereby fixing the housing parts axially. This assembly ensures that the housing parts are joined in a precisely fitting and simple way, with only the necessary degrees of freedom of the housing parts relative to each other being present.

If the nozzle pipe is clogged the performance of the spray gun must be restored. For this purpose the nozzle pipe must be easily dismantled and then cleaned or replaced in a simple manner. This is obtained according to an advantageous development of the invention if the housing part bearing the connecting part is penetrated by the nozzle needle, has on its side opposite the projection a receiving apparatus for the nozzle pipe and bears a union nut for bracing the nozzle pipe on the housing part.

According to an advantageous embodiment of the invention, a snap-in element is disposed between the housing part bearing the connecting part and the housing part bearing the handle part. This measure ensures that the pressure can for the medium remains in the adjusted locked position. The number of snap-in positions can be produced as desired, thereby permitting the right adjusting angle for every situation.

The snap ring already fixes the two housing parts axially relative to each other. The housing parts thus have an exactly defined position relative to each other, thereby permitting a plurality of well-marked snap-in points to be realized on the circumference. For this purpose axially acting snap-in elements are preferably present on the housing part bearing the handle part to cooperate with snap-in notches provided on the housing part bearing the connecting part. A small number of component parts can be obtained according to a development of the invention if the snap-in element consists of at least one stop spring injection-molded on the housing part bearing the handle part, the snap-in tab of said spring protruding beyond the front wall of the bore receiving the projection, and the snap-in notches cooperating with the stop springs being located on a circumferential shoulder on the housing part bearing the connecting part, the projection extending from said shoulder into the bore.

One can vary the snap-in forces if, according to a further advantageous embodiment, the snap-in element consists of at least one spring-loaded snap-in block inserted in a holding base and penetrating the latter through a guide bore, the holding base being fastened in a window in the housing part bearing the handle part, and the snap-in notches cooperating with the snap-in block being located on a face of the projection inserted into the bore of the housing part bearing the handle part. One can thus influence the snap-in force merely by changing the spring element under the snap-in block. By using a projection with a different number of snap-in notches one can provide a different number of snap-in positions by these measures.

One can dispense with the snap ring and thus make production more cost-effective if, according to an advantageous embodiment, the holding base inserted in the window of the housing part bearing the handle part engages the groove in the projection of the housing part bearing the connecting part and fixes the housing parts axially, the snap-in notches for cooperation with the spring-loaded snap-in block located in the holding base being set in a flank of the groove.

In an alternative embodiment of the invention, radially acting snap-in elements are provided between the housing part bearing the handle part and the housing part bearing the connecting part. This measure provides relief for the axial fixation of the two housing parts relative to each other since the snap-in forces do not act in the axial direction. It is easier to influence the snap-in forces since they are not mixed with the axial frictional forces.

A soft design of the snap-in forces is obtained according to an advantageous development of the invention if a stop spring is present preferably on the projection of the housing part bearing the connecting part to cooperate with snap-in notches located in the bore of the housing part bearing the handle part.

In a cost-effective construction according to a further embodiment, which also permits the snap-in forces to be influenced, the projection of the housing part bearing the connecting part has a spring groove in which the stop spring formed from spring steel and having at least one snap-in tab is fixed by a fastening element.

According to a further advantageous embodiment, the projection of the housing part bearing the connecting part has a circumferential snap-in groove having snap-in notches which cooperates with a spring-loaded snap-in block guided in the housing part bearing the handle part. This measure ensures the realization of a greater number of snap-in positions and an easy exertion of influence on the snap-in force.

One achieves a reduction of parts and thus more economical production by dispensing with the snap ring. The snap-in notches are expediently worked into the groove in the projection of the housing part bearing the connecting part, the snap-in tips being set deeper than the diameter of the projection, and the housing parts being fixed axially by a side flank of the spring-loaded snap-in block inserted into the groove and guided in the housing part bearing the handle part.

Figure 2:
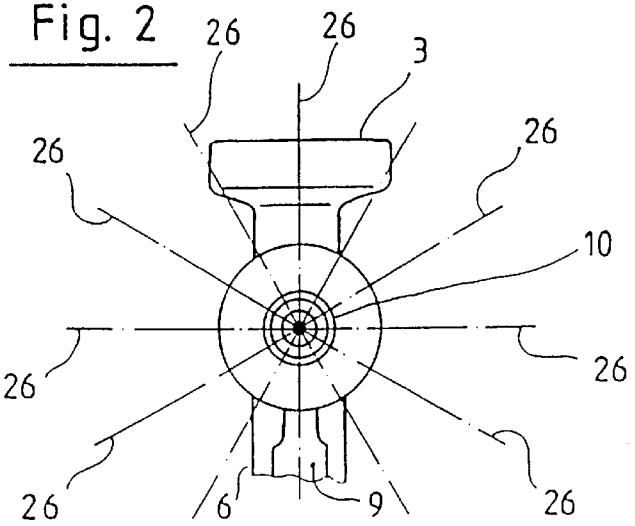
Figure 3:
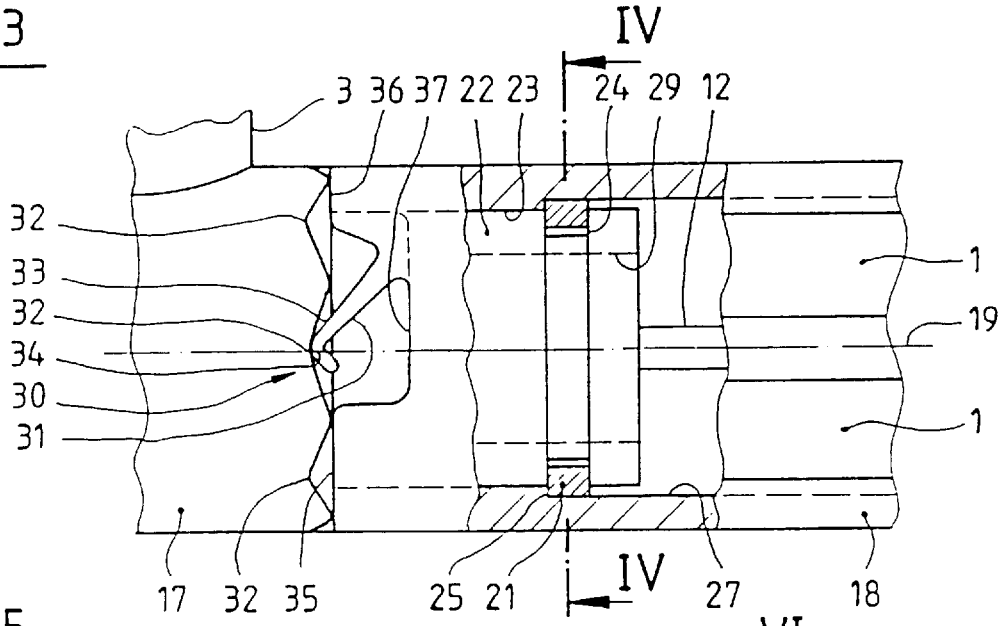
Figure 5:
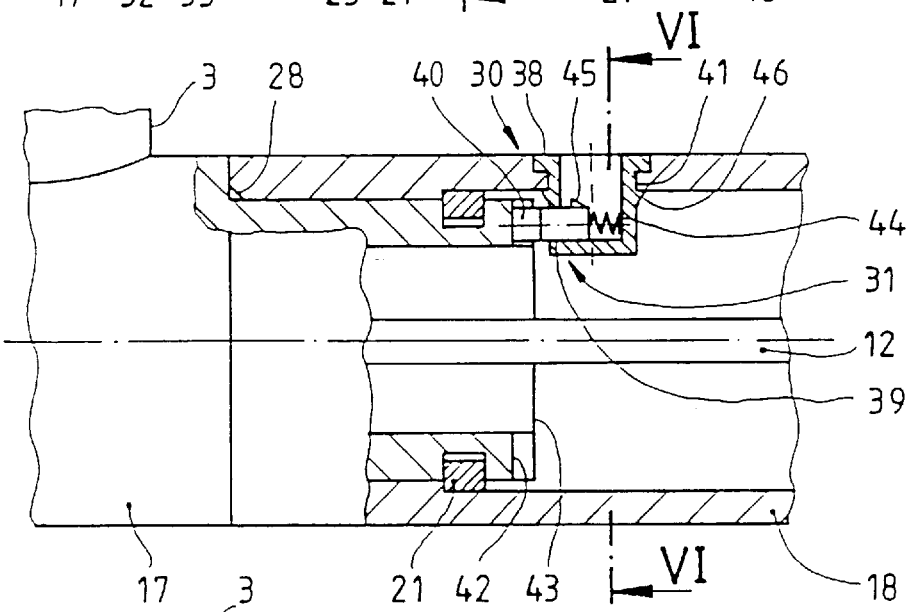
Figure 4:
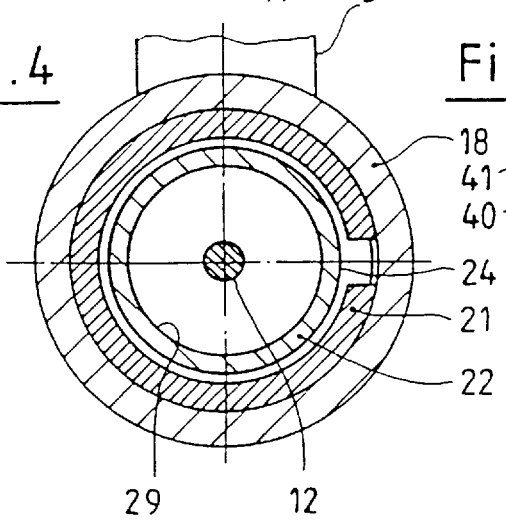
Figure 6:
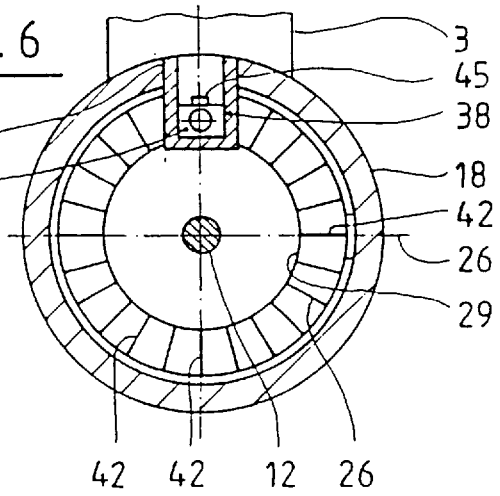
Figure 7:
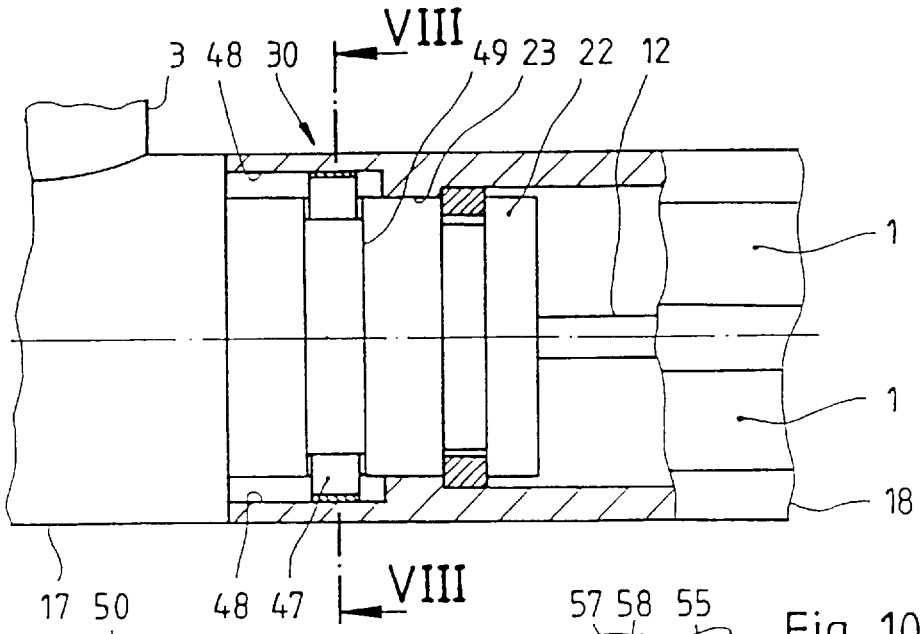
Figure 8:
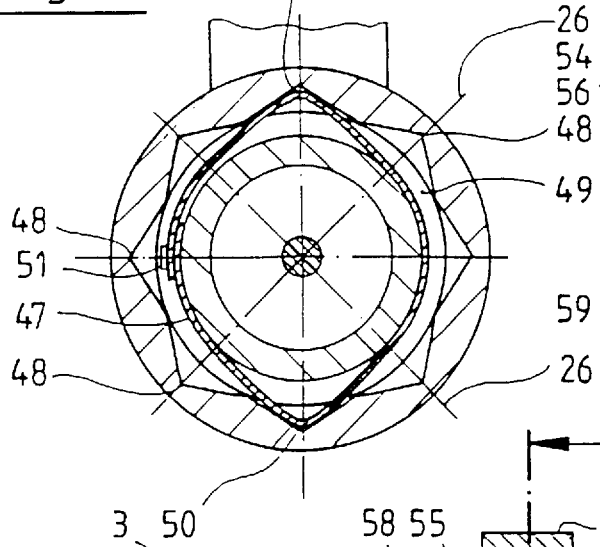
Figure 10:
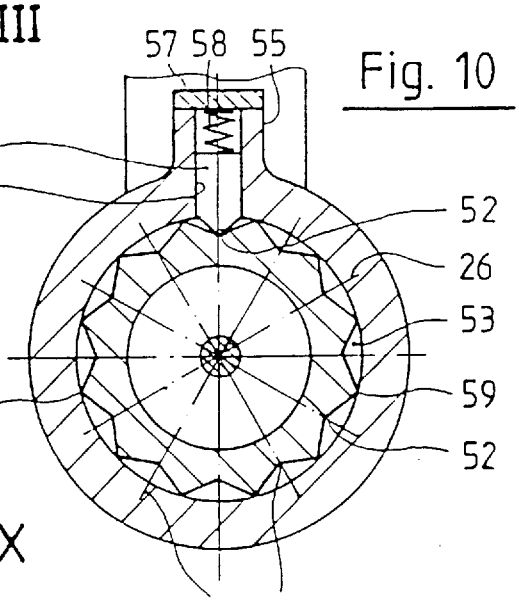
Figure 9:
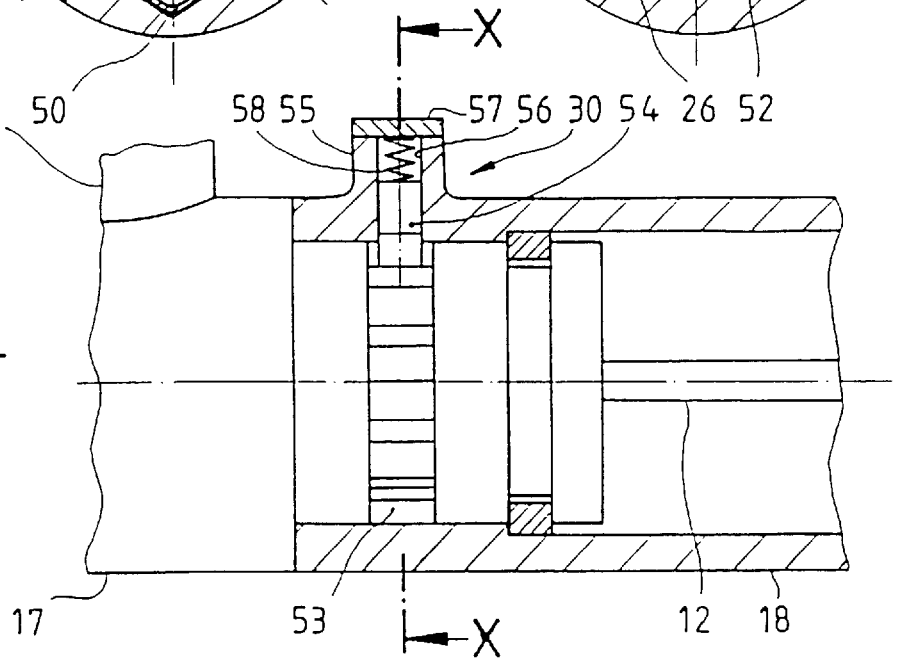
Figure 11:
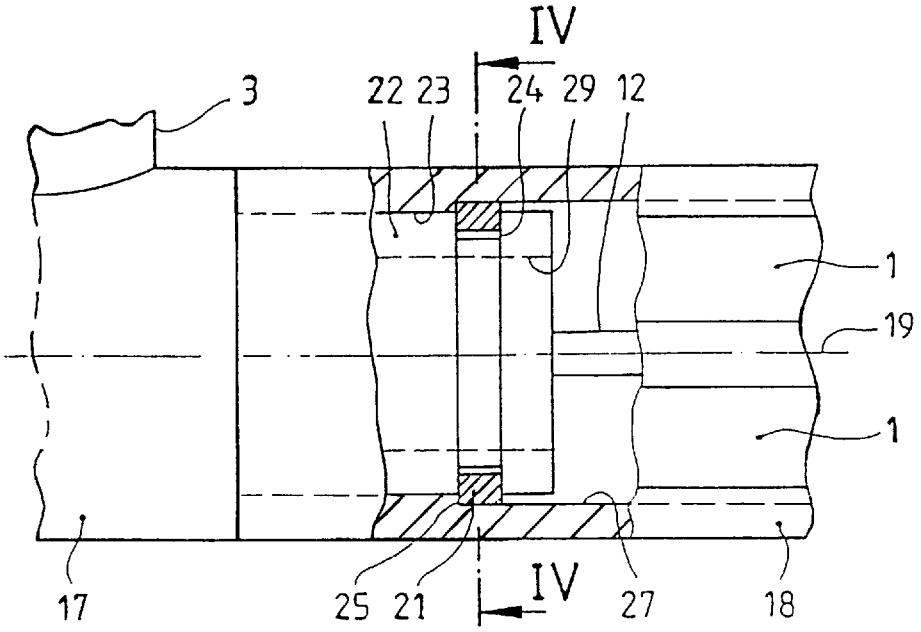

The idea underlying the invention will be explained more closely in the following description with reference to several embodiments shown in the drawing, in which:

FIG. 1 shows a side view of a spray gun according to the invention,

FIG. 2 shows a view of the spray gun of FIG. 1 in the direction of arrow II, FIG. 3 shows a partial section of detail III according to FIG. 1 on an enlarged scale, FIG. 4 shows a section through FIG. 3 along line IV—IV, FIG. 5 shows an alternative embodiment according to FIG. 3, FIG. 6 shows a section through FIG. 5 along line VI—VI, FIG. 7 shows an alternative embodiment according to FIG. 3, FIG. 8 shows a section through FIG. 7 along line VIII—VIII, FIG. 9 shows an alternative embodiment according to FIG. 7, FIG. 10 shows a section through FIG. 9 along line X—X, and FIG. 11 shows a partial section of detail III according to FIG. 1 on an enlarged scale of a further embodiment of the invention.

Formed on cylindrical housing 2 of the spray gun according to FIG. 1, said housing having adjacent flattened areas 1 on the outside, are on one hand connecting part 3 for receiving a pressure can for the medium (not shown) on the upper side, and on the other hand handle part 6 on the underside. Opposite handle part 6 there is bar 7 on the upper side of housing 2 to be used for suspending the spray gun. Handle part 6 has associated therewith pivoted lever 9 mounted in housing 2 with bearing pin 8 for operating spring-loaded nozzle needle 12 extending through housing 2 and nozzle pipe 10 with nozzle 11 fastened to housing 2. Nozzle pipe 10 is divided by step 13 into receiving area 4 associated with housing 2 and nozzle area 5 associated with nozzle 11. The shifting path of nozzle needle 12 can be changed via adjustment screw 14 protruding beyond the back of housing 2. The front and back of cylindrical housing 2 are closed by corresponding union nuts 16 and 15, respectively. Union nut 15 furthermore bears the thread for adjustment screw 14. Union nut 16 fixes nozzle pipe 10 on housing 2. On dividing line 20 housing 2 is divided into housing part 17 with connecting part 3 and housing part 18 with handle part 6. Housing part 17 bearing connecting part 3 for the pressure can for the medium is adapted to be rotated around axis 19 of nozzle needle 12 relative to housing part 18 bearing handle part 6. If a snap-in system is provided, housing part 17 with connecting part 3 assumes snap-in positions 26 for example (FIG. 2).

On housing part 17 bearing connecting part 3 there is projection 22 which bears snap ring 21 in groove 24. Set in housing part 18 bearing handle part 6 is bore 23 into which projection 22 bearing snap ring 21 is inserted. Housing part 18 has shoulder 25 formed by the coincidence of bore 23 with housing bore 27. When projection 22 provided with snap ring 21 is inserted into bore 23, which is facilitated by bezel 28, snap ring 21 jumps up behind shoulder 25, thereby fixing housing parts 17 and 18 axially. Through projection bore 29 nozzle needle 12 is guided both through projection 22 and through housing part 17. In housing part 17 there is furthermore a sliding seat (not shown) for nozzle needle 12 which at the same time constitutes the rear limit of projection bore 29 so that no foaming agent can pass into the interior of housing part 18. For this purpose suitable seals are provided on the sliding seat. Nozzle needle 12 thus penetrates housing part 17 bearing connecting part 3 and extends up to nozzle 11 on nozzle pipe 10. On the side opposite projection 22 housing part 17 has a receiving apparatus for nozzle pipe 10. By means of union nut 16 nozzle pipe 10 is braced on housing part 17. The receiving apparatus for nozzle pipe 10 can be designed as shown in DE 37 10 395 A1.

Snap-in system 30 is disposed between housing part 17 bearing connecting part 3 and housing part 18 bearing handle part 6. Axially acting snap-in element 31 is present on housing part 18 bearing handle part 6 and cooperates with snap-in notches 32 provided on housing part 17 bearing handle part 3.

According to FIG. 3 snap-in element 31 consists of at least one stop spring 33 injection-molded on housing part 18 bearing handle part 6. Chamber 37 in housing part 18 ensures that stop spring 33 is molded free and can thus spring. Snap-in tab 34 of stop spring 33 protrudes beyond front wall 35 of housing part 18 and thus beyond bore 23 receiving projection 22. On circumferential shoulder 36 on housing part 17 bearing connecting part 3 there are snap-in notches 32. From shoulder 36 projection 22 extends into bore 23 of housing part 18. Snap-in tabs 34 of stop springs 33 protruding beyond front wall 35 cooperate with snap-in notches 32 present in shoulder 36, thereby fixing the snap-in positions. By varying the thickness of the stop springs and changing the projecting length of the snap-in tab beyond the front wall one can influence the snap-in force. When housing part 17 is rotated around axis 19, stop spring 33 springs elastically into chamber 37. The particular shifting path is influenced by snap-in notches 32. Only in next snap-in notch 32 is snap-in position 26 fixed again after unbending of stop spring 33, whereby snap-in tab 34 comes to lie in snap-in notch 32.

According to FIG. 5 snap-in element 31 consists of spring-loaded snap-in block 40 inserted in holding base 38. Holding base 38 has guide bore 39 in which the snap-in block slides. Pressure spring 44 is inserted in snap-in block 40 and supported on a wall of holding base 38, thereby urging snap-in block 40 toward snap-in notches 42. Spring-back clip 45 permits axial insertion of snap-in block 40 into guide bore 39 and prevents snap-in block 40 from falling out of holding base 38. In window 41 in housing part 18 bearing handle part 6, holding base 38 is fixed by clips 46. The snap-in force is thus exerted via snap-in block 40, pressure spring 44 and via holding base 38 on housing part 18. By changing the angle of snap-in notches 42 or snap-in block 40 and changing the pressure spring one can influence the snap-in force.

According to an alternative not shown in the drawing, holding base 38 engages groove 24 in projection 22 of housing part 17. Holding base 38 is fixed via clips 46 in housing part 18, the width of holding base 38 corresponding to the width of groove 24. One of the flanks of groove 24 bears the snap-in notches for cooperation with spring-loaded snap-in block 40 located in holding base 38. Holding base 38 thus replaces snap ring 21 and ensures axial fixation of housing parts 17, 18 relative to each other.

In FIGS. 7 to 9 radially acting snap-in elements 30 are provided between housing part 18 bearing handle part 6 and housing part 17 bearing connecting part 3. FIGS. 7 and 8 show an alternative in which stop spring 47 is present on projection 22 of housing part 17 bearing connecting part 3. Snap-in notches 48 are disposed in bore 23 of housing part 18 bearing handle part 6. Stop spring 47 of housing part 17 co-operates with snap-in notches 48 of housing part 18. Spring groove 49 is set in projection 22 of housing part 17. In spring groove 49 there is stop spring 47 formed from spring steel and having two snap-in tabs 50. Fastening element 51 fixes stop spring 47 in spring groove 49.

FIGS. 9 and 10 show a further embodiment. On projection 22 of housing part 17 there is circumferential snap-in groove 53. Snap-in notches 52 are worked into snap-in groove 53. Dome 55 closed with plate 57 is disposed on housing part 18 and has guide bore 56 for spring-loaded snap-in block 54. Pressure spring 58 is supported on plate 57 and urges snap-in block 54 toward snap-in notches 52 on projection 22. By changing the angles of snap-in notches 52 and snap-in block 54 and varying pressure spring 58 one can influence the snap-in force.

In an embodiment not shown in the drawing, snap-in notches 52 are worked into groove 24 in projection 22 of housing part 17 bearing connecting part 3. Snap-in tips 59 are set deeper than the diameter of projection 22. A side flank of spring-loaded snap-in block 54 guided in dome 55 and inserted into groove 24 thereby fixes housing parts 17 and 18 axially. Thus snap ring 21 is omitted again. Snap-in block 54 expediently has the width of snap-in groove 53.

FIG. 11 shows a further embodiment of the invention in which the rotatable design of the housing part bearing the connecting part for the pressure can is based, not on the arrangement of snap-in elements, but on the frictionally engaged mounting of projection 22 of housing part 17 bearing connecting part 3 in bore 23 of housing part 18 bearing handle part 6. Projection 22 is fitted into bore 23 in such a way that housing part 17 with connecting part 3 can be rotated only using a minimum force; as a result connecting part 3 with the mounted pressure can remains in the selected position relative to the spray gun until another application of force changes this position. The reference signs designate the same positions as in FIG. 3.

With the inventive spray gun the foaming agent passes from the pressure can (not shown) via connecting part 3 into the interior of housing part 17 which is closed at the back, from housing part 18 bearing handle part 6, by a dividing wall through which nozzle needle 12 is guided centrally. Obviously suitable sealing elements are present to prevent foaming agent from entering the interior of housing part 18 from the back. At the front the foaming agent can enter nozzle pipe 10 through the interior of housing part 17. In the inoperative position of nozzle needle 12 nozzle 11 remains closed, being released upon operation of pivoted lever 9 and withdrawal of nozzle needle 12.

I claim:

1. A spray gun, comprising:

a housing for receiving a pipe having a nozzle at a free end thereof, said housing including a first housing and a second housing, the first housing having a handle, a shoulder and a bore, and the second housing having a connecting part for a pressure can and a projection for insertion into the bore of the first housing, the projection having a snap ring and a groove in which the snap ring is disposed;

a spring-loaded needle for acting on an opening of the nozzle, said needle extending into the pipe and operable via a pivoted lever mounted on said housing, said needle having an axis therethrough;

wherein the second housing is rotatable around the needle axis and relative to the first housing and the snap ring is movable beyond the shoulder of the first housing for axially fixing the first and second housings.

2. The spray gun of claim 1, the second housing further comprising an apparatus disposed opposite the projection for receiving the pipe and a nut for bracing the pipe on the second housing.

3. The spray gun of claim 1, further comprising a snap-in system for axially fixing the first housing and the second housing relative to one another.

4. The spray gun of claim 3, wherein the snap-in system comprises a plurality of snap-in notches on the second housing and at least one snap-in element on the first housing for cooperation with the snap-in notches.

5. The spray gun of claim 4, wherein the snap-in element comprises at least one stop spring on the first housing, the stop spring having a snap-in tab which extends beyond a front wall of the bore of the first housing, wherein the snap-in notches are located on a shoulder of the second housing, and wherein the projection extends from the shoulder of the second housing into the bore of the first housing.

6. The spray gun of claim 4, wherein the snap-in element comprises at least one spring-loaded, snap-in block inserted in a holding base through a guide bore, the holding base being fixed in a window in the first housing and the snap-in notches being disposed on a face of the projection inserted into the bore of the first housing.

7. The spray gun of claim 1, further comprising snap-in elements disposed between the first housing and the second housing.

8. The spray gun of claim 7, further comprising a plurality of snap-in notches on the bore of the first housing and a stop spring on the projection of the second housing.

9. The spray gun of claim 8, wherein the stop spring has at least one snap-in tab and the projection of the second housing has a spring groove in which the stop spring is fixed by a fastening element.

10. The spray gun of claim 7, further comprising a spring-loaded, snap-in block guided in the first housing, wherein the projection of the second housing has a snap-in groove including snap-in notches, the snap-in groove cooperating with the snap-in block.

11. A spray gun, comprising:

a housing for receiving a pipe having a nozzle at a free end thereof, said housing including a first housing and a second housing, the first housing having a handle and a bore, and the second housing having a connecting part for a pressure can and a projection for insertion into the bore of the first housing;

a snap-in system for axially fixing the first housing and the second housing relative to one another;

a spring-loaded needle for acting on an opening of the nozzle, said needle extending into the pipe and operable via a pivoted lever mounted on said housing, said needle having an axis therethrough;

wherein the second housing is rotatable around the needle axis and relative to the first housing.

12. The spray gun of claim 11, wherein the snap-in notches are disposed in a flank of the groove of the projection and the holding base engages the groove and axially fixes the first and second housings.

13. The spray gun of claim 11, wherein the snap-in system comprises radially acting snap-in elements.

14. The spray gun of claim 13, further comprising a spring-loaded, snap-in block guided in the first housing, wherein the projection of the second housing has a snap-in groove including snap-in notches, the snap-in groove cooperating with the snap-in block.

15. The spray gun of claim 14, wherein the snap-in notches are worked into the groove of the projection, the snap-in notches defining snap-in tips which are set deeper than a diameter of the projection of the second housing, and wherein the first and second housings are axially fixed by a side flank of the snap-in block.

* * * * *